US007450018B2

(12) United States Patent
Kawanaka

(10) Patent No.: US 7,450,018 B2
(45) Date of Patent: Nov. 11, 2008

(54) TEMPERATURE WARNING DEVICE BY DEFORMATION OR EXPANSION OF A BOLT AND THE DEVICE STRUCTURE

(75) Inventor: Hiroshi Kawanaka, Matsusaka (JP)

(73) Assignee: Gosei Nakagawa, S.A., Vitoria-Gasteiz (ES)

( * ) Notice: Subject to any disclaimer, the term of this patent is extended or adjusted under 35 U.S.C. 154(b) by 196 days.

(21) Appl. No.: 10/577,882

(22) PCT Filed: Oct. 28, 2003

(86) PCT No.: PCT/ES03/00554

§ 371 (c)(1),
(2), (4) Date: Nov. 16, 2006

(87) PCT Pub. No.: WO2005/041236

PCT Pub. Date: May 6, 2005

(65) Prior Publication Data

US 2007/0081574 A1 Apr. 12, 2007

(51) Int. Cl.
*G08B 17/06* (2006.01)

(52) U.S. Cl. ..... 340/593; 337/112; 356/328

(58) Field of Classification Search ..... 340/593; 337/112

See application file for complete search history.

(56) References Cited

U.S. PATENT DOCUMENTS 4,367,443 A * 1/1983 Hull et al. ..... 330/207 P
4,504,414 A * 3/1985 Folkers et al. ..... 530/313
4,504,814 A 3/1985 Roberts et al.
4,645,344 A * 2/1987 Thevenon ..... 356/328
5,416,970 A * 5/1995 Kadlubowski ..... 29/622

FOREIGN PATENT DOCUMENTS

| | | |
|---|---|---|
| EP | 0 351 050 | 10/1992 |
| EP | 0 821 468 | 3/2004 |
| GB | 968111 | 8/1964 |
| JP | 55-126918 | 10/1980 |

* cited by examiner

*Primary Examiner*—Jeff Hofsass
*Assistant Examiner*—Ojiako Nwugo
(74) *Attorney, Agent, or Firm*—Katten Muchin Rosenman LLP

(57) ABSTRACT

Temperature sensor device that allows changes of temperature (14) to be detected, as the materials that form said device (1) are deformed, that consists of a body formed by two valves (2) and a structure (8) provided in the hollow interior (7), so that they join together with the aid of a number of bolts (5), it having been envisaged that in one of the bolts (5) and in the structure (8) electrical terminals (4) are positioned, separated a distance (12) from each other, so that when an increase in temperature (14) takes place, it causes the deformation of the components of the device (1), allowing contact of the electrical terminals on having reached the critical temperature (14), and producing the activation of a warning device (13) with the aid of a conductive medium (10)

10 Claims, 3 Drawing Sheets

TEMPERATURE WARNING DEVICE BY DEFORMATION OR EXPANSION OF A BOLT AND THE DEVICE STRUCTURE

This application is the National Stage of International Application No. PCT/ES2003/000554, filed Oct. 28, 2003, which is herein incorporated by reference.

OBJECT OF THE INVENTION

The present invention refers to a sensor device that reacts to changes of temperature as the materials that form the device are deformed.

The purpose of the invention is a device that allows abrupt changes of temperature within short periods of time to be detected, activating any warning device, indicator or activator, such as buzzers, alarms, luminous indicators, extinguisher activators, etc.

BACKGROUND OF THE INVENTION

At the state of the technique the existence of sensor devices is known which react to sudden changes of temperature that have their principal application in detecting fires in a given place, so that, on having detected a given increase of temperature, the device reacts giving an alarm indication.

These temperature sensor devices are also used in the detection of abnormal increases of temperature in facilities that have cabinets with electronic or electrical equipment.

Thus, at the level of the technique we find devices such as that presented in the European patent EP 351.050 that describes an ultrasonic temperature detector that has a wave guide that is arranged in such a way that the local warming caused by a fire changes its acoustic impedance, in the area where the warming has occurred.

On the other hand, in the document EP 821.468 a system to control the temperature of an electronic component, that includes a thermal strip temperature detector, is shown.

DESCRIPTION OF THE INVENTION

The temperature sensor device that is proposed refers to a sensor that reacts to changes of temperature as the materials that form the device are deformed, allowing sudden changes of temperature in short periods of time to be detected, activating any warning device, indicator or activator, such as buzzers, alarms, luminous signals, fire-extinguishers activators, etc.

One of its principal applications is for example that of detecting fires in a given enclosure or building, so that, on having detected a predetermined increase in temperature, the device reacts giving an alarm signal.

These temperature sensor devices can also be used in the detection of abnormal increases of temperature in facilities that have cabinets with electronic or electrical equipment.

The body of the device comprises at least two equal parts, called shells, of cylindrical section in their central area and of spherical section in the sides, having an outlet channel in one of the sides. After these two shells join with each other, an internal hollow, that provides an outlet channel through one of the ends of the device, is formed.

In the interior face of the shells, a number of tiered cylindrical ledges have been envisaged, preferably equidistant, that include a number of blind apertures for the coupling of the shells. Said cylindrical ledges are arranged so that at least one is close to the near end of the outlet channel, at least another at the opposite end and at least another in the central zone.

In addition, there is a large number of bolts, as many as cylindrical ledges, which have a cylindrical shape with the ends rounded, that are tightly introduced into the blind orifices of the cylindrical ledges, allowing the coupling of the shells.

In the internal hollow the device has a structure, preferably rectangular, of section, preferably circular. Said structure can have at least one bolt, so that it is positioned in the central part of one of the side branches in the case that the structure is rectangular. This bolt could be integral with the structure or be detachable. The end of the structure where the bolt is positioned will preferably be located at the end close to the outlet channel.

In addition, at the opposite end to that of the bolt, said structure has an electrical terminal, preferably metallic. To said electrical terminal a conductive medium is joined through a connecting element, preferably by welding, in a way that said conductive medium emerges outside of the internal hollow between shells through the output channel.

In the blind apertures of the cylindrical ledges located in the central zone of the shells, both sides of the bolt are tightly introduced, so that it allows the distance between shells in the central zone of the device to be maintained.

In the blind aperture located at the opposite end to that in which the bolt positioned in the structure has been inserted, another bolt is placed whose central part has a metallic end of an electrical terminal, preferably metallic.

To said electrical terminal a conductive medium is joined through a connecting element, preferably by welding, in a way that said conductive medium emerges outside of the internal hollow between shells through the outlet channel.

In this way, the two electrical terminals would remain positioned at a definite distance, it being envisaged that this distance will vary as a function of the temperature, because of the property of dilation of the plastic components that form the appliance, in such a way that on reaching a given critical temperature, contact between both terminals is produced, closing the circuit and activating any warning device, indicator or activator, such as buzzers, alarms, luminous signals, extinguisher activators, etc.

The distance between the electrical terminals is planned according to the coefficients of dilation or of deformation that the prime material of the components that make up the device have, as well as of the critical temperature for giving the alarm signal. In this way, the distance between the electrical terminals will be tabulated according to the prime material used in the manufacture of the components of the device, likewise of the characteristics of the means of control.

The prime material used in the manufacture of the components of the devices has to ensure that all the components have the same characteristics so that they react in the same way when being subjected to the same increase in temperature, that is, that they undergo the same process of deformation when subjected to the same temperature change.

The prime material used in the manufacture of the components could be plastic, so that all the components of the device are obtained from a base of a single mould or moulding operation, so that they have the same characteristics.

All these components must be carried out in a high precision process, as regards dimensions, since the reaction of the device depends on the relative position between components.

DESCRIPTION OF THE DRAWINGS

To supplement this description and with the aim of leading to a better understanding of the characteristics of the invention, in accordance with a preferred example of its practical embodiment, as an integral part of this description it is accompanied by a set of drawings where in an illustrative and non-limiting way, the following have been represented.

PREFERABLE EMBODIMENT OF THE INVENTION

Figure 1:
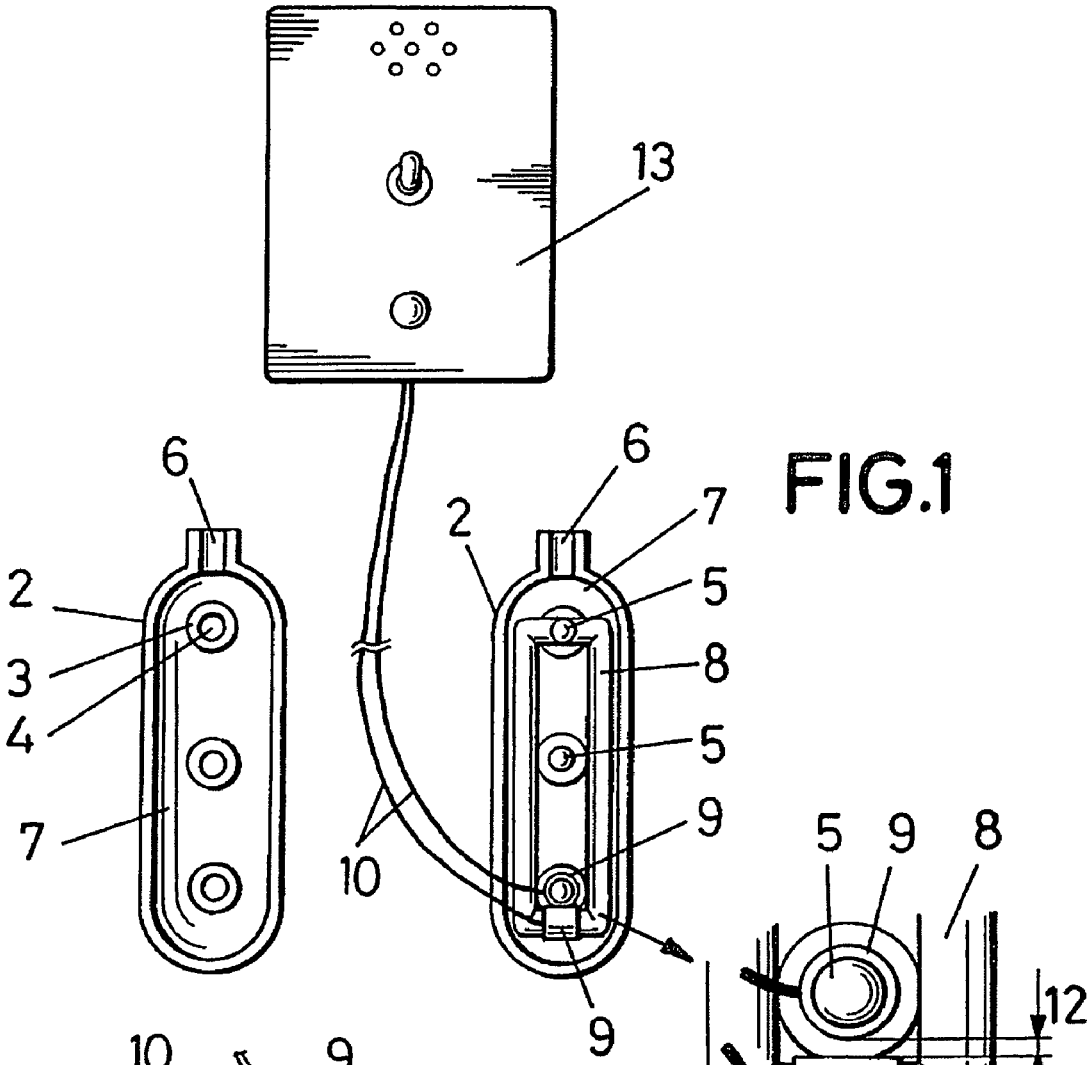
FIG. 1. Shows a plan schematic representation of the temperature sensor device, with the two shells uncoupled.
Figure 2:
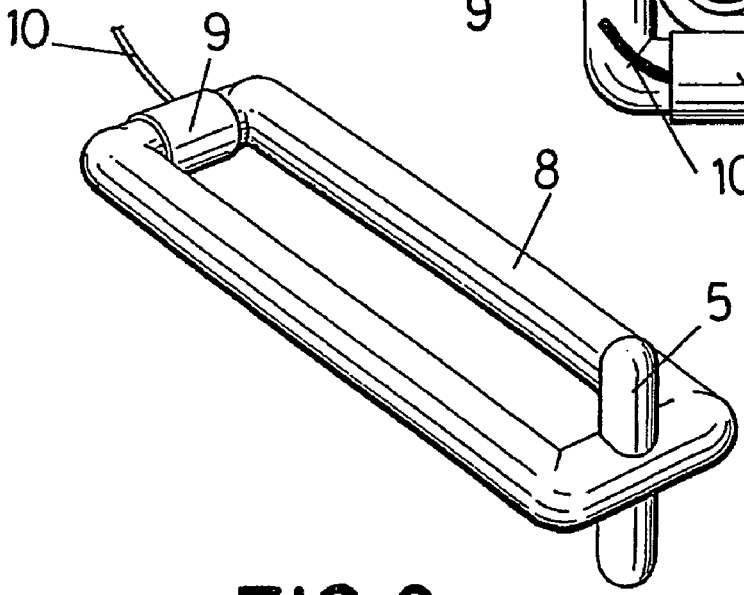
FIG. 2. Shows a representation of the rectangular structure in perspective.
Figure 3:
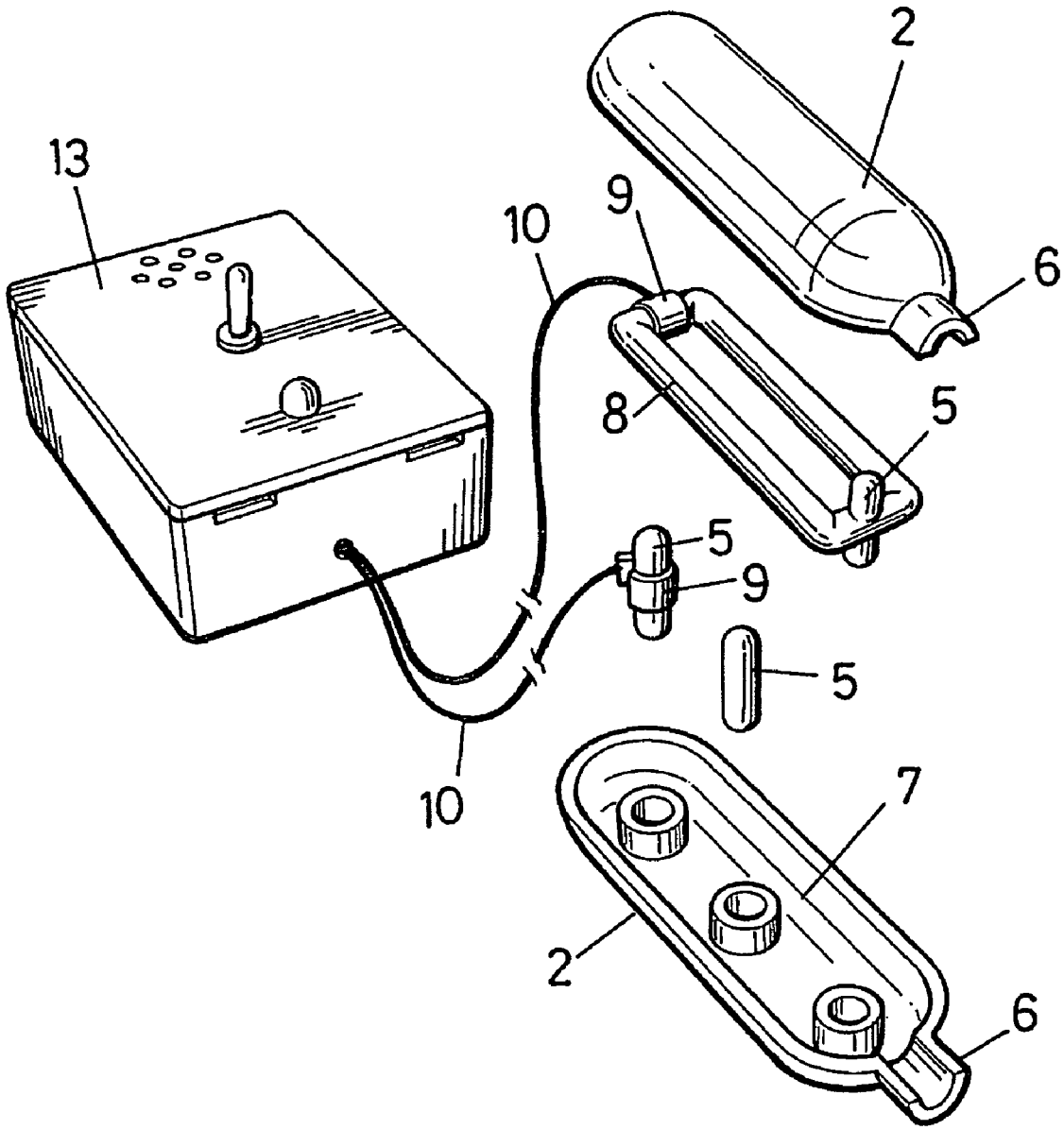
FIG. 3. Shows a blow-up schematic representation of the temperature sensor device, connected to the warning device.
Figure 4:
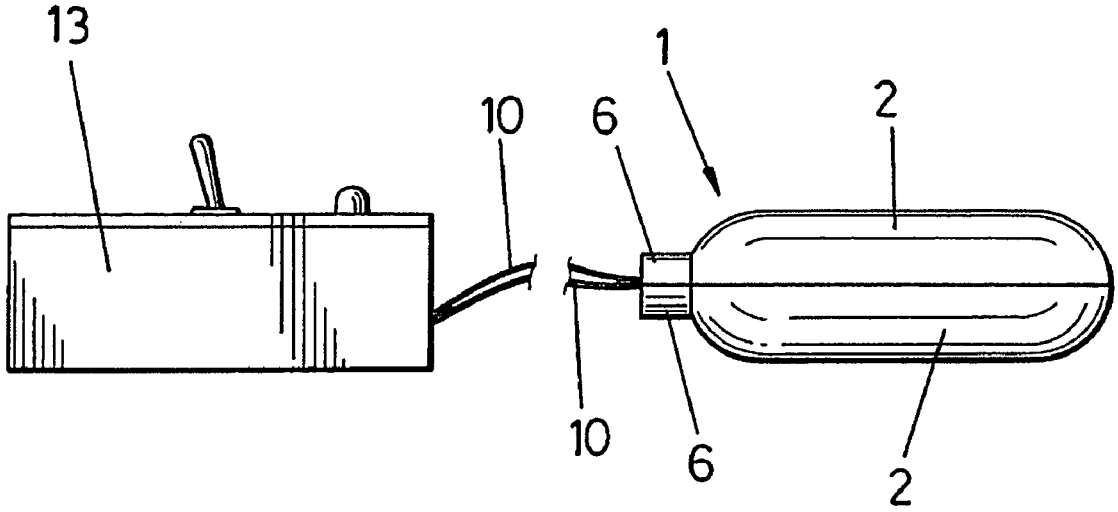
FIG. 4. Shows a elevation schematic representation of the temperature sensor device, connected to the warning device.

According to the drawings shown, the body of the device is formed by two shells (2), of cylindrical section in their central area and of spherical section in the sides, having an outlet channel (6) in one of the sides. After these two shells are coupled with each other, like a bulb, an internal hollow (7) is formed, that has an outlet channel through one of the ends of the device (1).

In the interior face of the shells (2), a number of tiered cylindrical ledges have been envisaged, preferably equidistant, that comprises a number of blind apertures (4) for coupling said shells (2). Said cylindrical ledges (3) are arranged so that at least one is close to the near end of the outlet channel (6), at least another at the opposite end and at least another in the central zone.

On the other hand a large number of bolts (5) are positioned, as many as cylindrical ledges (3), which have a cylindrical shape with the ends rounded, that are tightly introduced into the blind orifices (4) of the cylindrical ledges (3), allowing the shells (2) to be coupled.

In the internal hollow (7) the device (1) further comprises a structure (8), preferably rectangular, of section, preferably circular. Said structure (8) can have at least one bolt (5), so that it is positioned in the central part of one of the side branches in the case that the structure (8) is rectangular. It will be possible for this bolt (5) to be integral with the structure (8) or to be detachable. The end of the structure (8) where the bolt (5) is positioned will, preferably, be located at the end close to the outlet channel (6).

In addition, at the opposite end to that of the bolt (5), said structure (8) has an electrical terminal (9), preferably metallic. To said electric terminal (9) a conductive medium (10) is joined through a junction element, preferably by welding, so that said conductive medium (10) emerges out from the internal hollow (7) between shells (2) through the outlet channel (6).

In the blind orifices (4) of the cylindrical ledges (3) located in the central zone of the shells (2), both sides of the bolt (5) are tightly introduced, so that it allows the distance between shells (2) in the central zone of the device (1), to be maintained.

In the blind orifice (4) located at the opposite end to that into which the bolt (5) of the structure (8) is positioned, another bolt (5) is positioned, in whose central part there is an electrical terminal (9), preferably metallic. To said electric terminal (9) a conductive medium (10) is joined through a junction element (11), preferably by welding, so that said conductive medium (13) emerges out from the internal hollow (7) between shells (2) through the outlet channel (6).

In this way, the two electrical terminals (9) would remain closely positioned, at a given distance (12) that will vary as a function of the temperature (14), due to the property of dilation of the plastic components that form the device (1), so that on reaching a given critical temperature (14) the contact between both electrical terminals (9) is produced, the circuit closing and activating any warning device (13) such as buzzers, alarms, luminous signals, extinguisher activators, etc.

The distance (12) between the electrical terminals (9) is planned according to the dilation or deformation coefficients of the prime material of the components that comprise the device (1), as well as according to the temperature (14) critical to give the alarm signal. In this way, the distance (12) between the electrical terminals (9) will be given as a function of the prime material used in the manufacture of the components of the device (1), likewise of the characteristics of the environment to be controlled.

The prime material (15) used in the manufacture of the components of the device (1) has to ensure that all the components have the same characteristics in order that they react in the same way on being subjected to the same increase of temperature (14), that is, that undergo the same process of deformation for the same changes of temperature (14).

It will be possible to use plastic as the prime material (15) used in the manufacture of the components so that all the components of the device (1) are obtained from a single mould or moulding operation, so that they have the same characteristics.

All these components must be accomplished in a process of great precision as regards dimensions, given that the reaction of the device (1) depends on the relative position between components.

The invention claimed is:

1. Temperature sensor device that allows changes of temperature to be detected as some of the components therein are deformed, comprising a hollow body formed by two shells (2), a structure (8) provided in the interior (7) of the hollow body, and a number of bolts (5) that join said shells (2) together, characterized in that one of the bolts (5) and the structure (8) are provided with electrical terminals (9) separated at a distance (12), said distance (12) being defined according to the deformation or expansion coefficient of said bolt (5) and structure (8), allowing contact between electrical terminals (9) once a critical temperature is reached.

2. Temperature sensor device, according to claim 1, characterised in that in the interior face of the shells (2), a number of tiered cylindrical ledges (3) are provided, preferably equidistant, that have a number of blind apertures (4).

3. Temperature sensor device, according to claim 1, characterised in that the body formed by the two shells has a cylindrical configuration with rounded ends, having an outlet channel (6) in one of said ends.

4. Temperature sensor device, according to claim 1, characterized in that the bolts (5) are tightly introduced into the blind orifices (4) of the cylindrical ledges (3), thus coupling the shells (2).

5. Temperature sensor device, according to claim 1, characterized in that the structure (8) has a rectangular shape and in one of their ends it has a bolt (5) that joins the shells (2), said bolt (5) being integral with the structure (8) or detachable.

6. Temperature sensor device, according to claim 5, characterized in that the structure (8) has an electrical terminal (9) at the opposite end to which said bolt (5) is located.

7. Temperature sensor device, according to claim 1, characterized in that the bolts (5) have cylindrical shape with the rounded ends.

8. Temperature sensor device, according to claim 1, characterized in that it comprises a warning device (13) that can be a buzzer, alarms, luminous signs or fire-extinguishers activators.

9. Temperature sensor device, according to claim 1, characterized in that the shells (2) and the structure (8) have same coefficients of dilation or of deformation, so that they react in the same way when being subjected to the same increase in temperature.

10. Temperature sensor device, according to the claim 1, characterized in that the shells (2) and the structure (8) components of the device (1) are plastic obtained from a single mould or moulding operation.

* * * * *